United States Patent [19]

Wilson

[11] 4,037,490

[45] July 26, 1977

[54] TWO-STEP CONTROL KNOB OPERATION

[75] Inventor: Arthur C. Wilson, Louisville, Ky.

[73] Assignee: General Electric Company, Louisville, Ky.

[21] Appl. No.: 646,415

[22] Filed: Jan. 2, 1976

[51] Int. Cl.[2] ..... H01H 3/10

[52] U.S. Cl. ..... 74/553; 74/548; 200/324; 116/124.2 A; 200/336

[58] Field of Search ..... 200/4, 321, 322, 324, 200/334, 329, 338, 42 R, 44, 11 R, 336, 156, 37 R, 38 A, 153 L, 153 LA, 153 LB; 74/548, 553; 116/124.2 A; 334/7, 53, 89

[56] References Cited

U.S. PATENT DOCUMENTS

| | | | |
|---|---|---|---|
| 2,501,008 | 3/1950 | Schramm | 74/548 |
| 2,704,466 | 3/1955 | Way | 74/553 |
| 2,981,808 | 4/1961 | Klein | 200/38 A |

*Primary Examiner*—Gerald P. Tolin

*Attorney, Agent, or Firm*—Richard L. Caslin; Francis H. Boos

[57] ABSTRACT

A push-to-turn knob design for a rotary switch to prevent accidental actuation of the switch by requiring a two-step operation sequence. This operating function is obtained without modifying the design of the rotary switch. Hence, a standard rotary switch can be easily converted to a push-to-turn operating sequence.

7 Claims, 6 Drawing Figures

TWO-STEP CONTROL KNOB OPERATION

BACKGROUND OF THE INVENTION

1. Field of the Invention

This invention relates to a design of a control knob for a control device such as a rotary switch, and particularly to one having a two-step function; as for example, a push-to-turn action.

2. Description of the Prior Art

A standard multiple rotary switch has a shaft that carries a knob with a handle for setting the switch in one of a plurality of switch settings, including an OFF position. From the point of view of safety in the use of kitchen appliances, it is important that the easily accessible switches not be capable of being set to an ON position inadvertently. For example, the selector switches that control the electric surface heating units of the cooktop of an electric range are usually accessible to small children. If a soiled frying pan, or a dishcloth, or a food package, were resting on the surface unit and the selector switch was accidentally moved to an ON position, the surface unit would be energized and a fire might be started before the situation could be corrected.

One solution is to design those switches, which are accessible and may become potential safety hazards, with a two-step function so it is difficult to inadvertently turn the switch ON.

This two-step function could be built into the switch mechanism at a cost increase, but, instead, the present invention contemplates simply modifying the control knob, at much less expense, to provide the two-step function.

An example of a standard control knob is shown in the Keeling/Baughman U.S. Pat. No. 3,176,541, which is assigned to the present assignee. This particular knob is for use with an oven thermostat and the knob is furnished with an adjusting means for recalibrating the thermostat.

An example of a two-step control knob is shown in the Marrapese U.S. Pat. No. 2,797,592, which shows a complex multi-part design of knob for an appliance switch or gas valve with a knob handle that turns freely and is inoperative unless it is first pushed and then turned. The knob has a clutch plate which must be engaged by pushing in on the handle before the turning of the handle becomes effective to operate the switch or valve.

Another example of a two-step control knob is shown in the Beare U.S. Pat. No. 3,227,826, which shows a push-to-turn timer switch where clutch teeth are provided on the timer knob which must engage with clutch teeth fixed with respect to the timer rotor shaft before any manual adjustment of the angular position of the cam discs is possible.

The principal object of the present invention is to provide a control device with a two-step feature before it can be set from an OFF position to any one of its ON positions by providing the control knob of the device with a releasable locking means for the OFF position.

A further object of the present invention is to provide a control device of the class described wherein the control knob is fixed from rotation while in the normal OFF position.

A further object of the present invention is to provide a control device of the class described where the control knob has a push-to-turn action at the OFF setting.

A further object of the present invention is to provide a control device of the class described where the two-step control knob can be used on a standard control device; hence, the two-step feature is external of the control device.

SUMMARY OF THE INVENTION

The present invention, in accordance with one form thereof, relates to a control device having an operating shaft and a control knob mounted on the shaft. An outer groove with a locking seat is formed on the hub portion, and a locking spring is fixed with relation to the control device for cooperation with the groove and for registry with the locking seat in the OFF position of the knob and of the control device.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
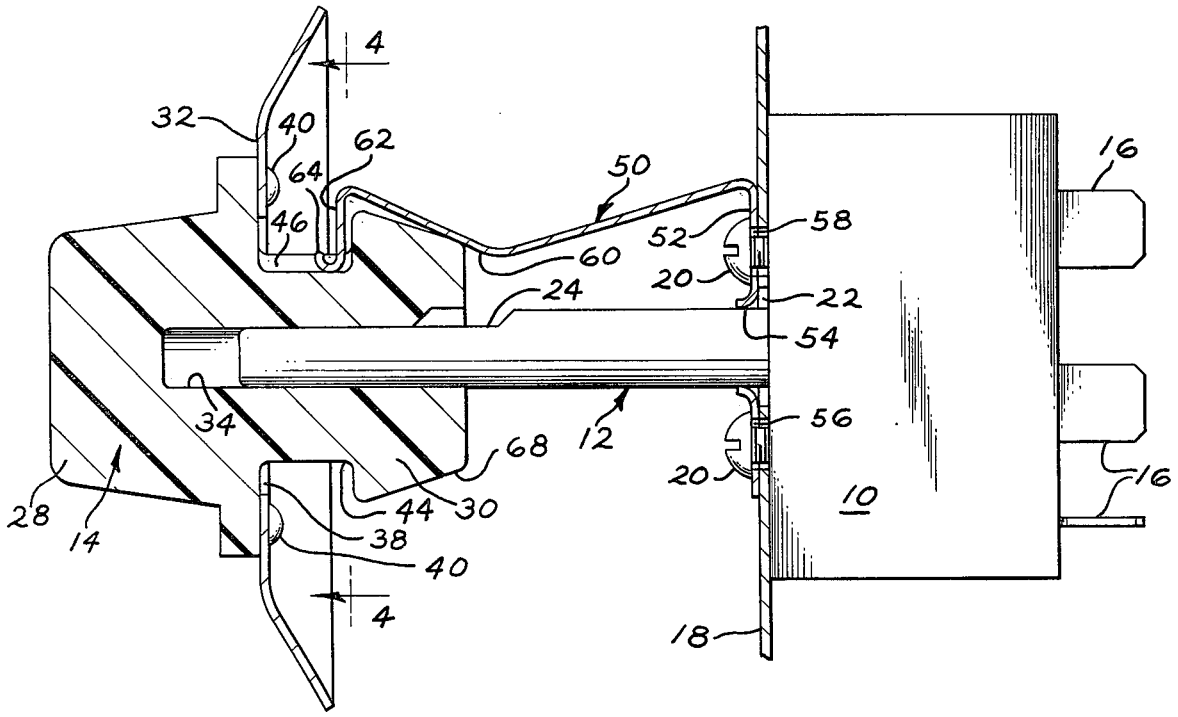
FIG. 1 is a side elevational view on an enlarged scale of a control device having an operating shaft that carries the control knob of the present invention, there being a locking spring fixed to the control device and cooperating with the knob (shown in cross-section) in its OFF position.
Figure 6:
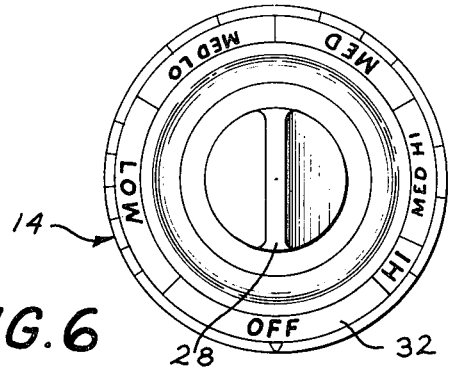
FIG. 6 is a front view on a reduced scale of the face of the knob of the present invention.
Figure 4:
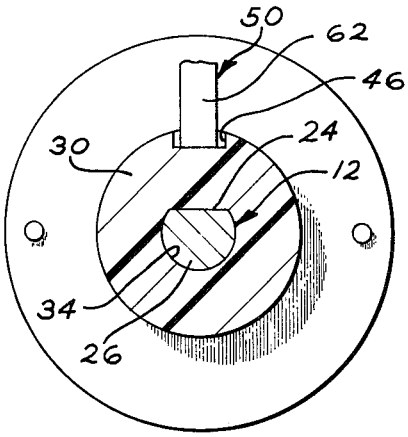
FIG. 4 is a transverse cross-sectional view through the hub portion of the knob, taken on the line 4—4 of FIG. 1.
Figure 5:
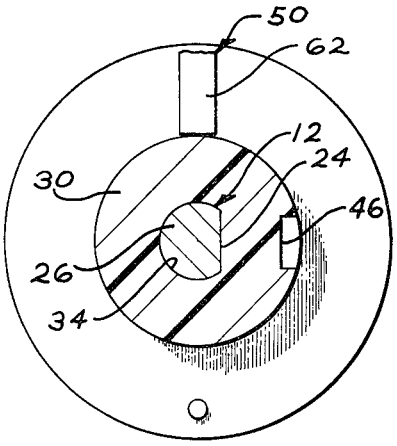
FIG. 5 is a cross sectional view similar to FIG. 4 but with the knob unlocked and turned, taken on the line 5—5 of FIG. 3.

Turning now to a consideration of the drawings, and in particular to FIG. 1, there is shown a multiple rotary switch 10 having an operating shaft 12 on which is mounted a control knob 14. The switch 10 has a number of switch positions, as may be understood from the indicia marked on the front face of the knob 14, as seen in FIG. 6. There is shown an OFF position and a series of LOW, MEDIUM and HIGH settings. At the back of the switch 10 are shown a plurality of electrical terminals 16 that are adapted to receive connectors of lead wires (not shown) for the switch in electrical circuits, such as for controlling the electric surface heating units of an electric range or cooktop. The switch 10 is supported by a separate mounting plate 18 and held in place by a pair of mounting screws 20. The shaft 12 extends through a hole 22 in the mounting plate. In practice, there would be a decorative control panel (not shown) covering the mounting plate. The free end of the shaft 12 has an elongated flat side 24 to create a D-shaped transverse cross-section 26, as is best seen in FIG. 4.

The control knob 14 has a handle portion 28, a hub portion 30 and a face plate 32. The hub portion 30 includes a bore 34 for receiving the D-shaped end 26 of the shaft, and the knob is capable of a sliding movement along the shaft. As shown in FIG. 1, the bore 34 may extend into the handle portion 28 because the knob must be capable of a sliding action along the shaft.

The face plate 32 is shown as an annular member with a center hole 38 so the face plate may slip over the hub portion 30 and be fastened to the back side of the handle portion 28 by means of screws 40. As mentioned above, the face plate 32 is provided with indicia showing various switch settings; as for example, is shown in FIG. 6.

The hub portion 30 of the knob 14 is provided with a circular groove 44 which encircles the hub. A narrow, elongated locking seat 46 is formed in the floor of the groove, and this elongated seat is generally parallel to the longitudinal axis of the shaft 12.

A locking spring 50 is adapted to cooperate with the groove 44 to create a push-to-turn operating sequence for the knob 14. The locking spring 50 is a cantilever spring having one end 52 fixed to the mounting plate 18 by providing that end with three holes 54, 56 and 58. Hole 54 is a central hole for slipping over the shaft 12 and the holes 56 and 58 are for receiving the mounting screws 20 therethrough.

The midportion of the locking spring 50 is formed with an inclined cam surface 60, while the free end of the spring has a transverse key 62 that is confined within the groove 44, and is biased to engage the locking seat 46 when these two are aligned, as is shown in the OFF position of FIG. 1. The tip of the key 62 is rounded at 64 so as to insure smooth sliding action and prevent binding or excessive wear of the plastic knob.

Figure 2:
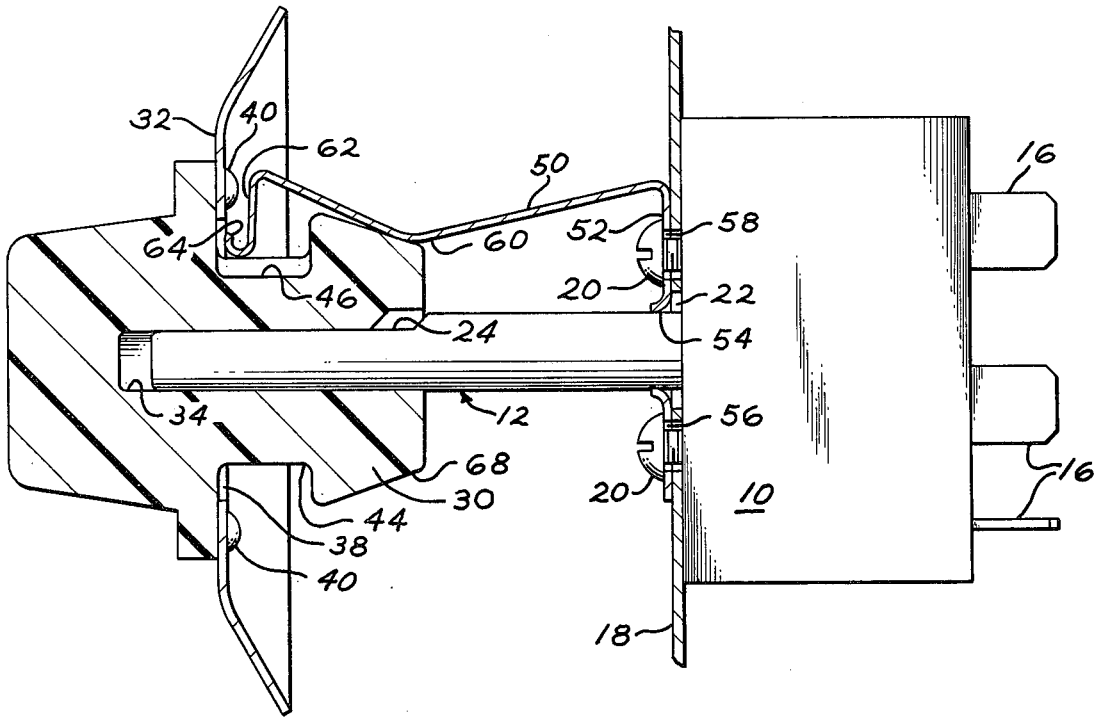
FIG. 2 is a side view similar to that of FIG. 1 showing the knob pushed in toward the control device, thereby raising the locking spring out of the locking seat by a camming action.
Figure 3:
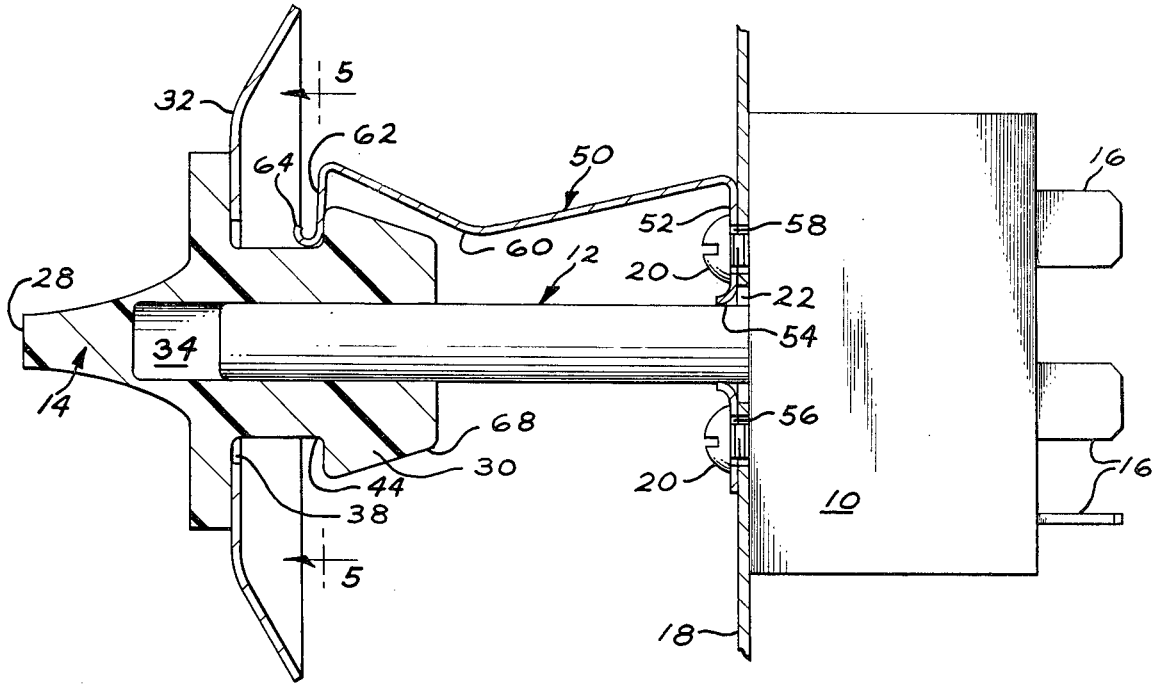
FIG. 3 is a side elevation view similar to that of FIG. 2 after the knob has been turned to one of its many ON positions.

The hub portion 30 has a tapered inner end 68 to form an inclined ramp that cooperates with the inclined cam surface 60 of the locking spring 50. Notice what happens in FIG. 2 when the knob 14 is pushed in on the shaft 12. The ramp or tapered end 68 engages the cam surface 60 and raises the spring 50 to lift the key out of the locking seat 46. Once the key 62 is free of the seat 46, then the knob 14 may be turned into any of the series of ON positions, as is shown in FIG. 3. The knob 14 is held on the shaft 12 by the fact that the key 62 is confined within the groove 44. Thus, the sliding action of the knob on the shaft is limited by the width of the groove 44.

Modifications of this invention will occur to those skilled in this art. Therefore, it is to be understood that this invention is not limited to the particular embodiments disclosed, but that it is intended to cover all modifications which are within the true spirit and scope of this invention as claimed.

I claim:

1. A control knob mounted on the shaft of a control device, said knob comprising:

a. a handle portion; and b. a hub portion to receive the shaft of the control device, the hub portion including an outer groove with a locking seat;

c. a locking spring means fixed with relation to the control device and cooperating with the groove of the hub portion for releasably holding the knob on the shaft as well as locking the knob from rotation when the locking spring engages the locking seat;

d. the knob being capable of limited longitudinal movement along the shaft;

e. the hub portion including release means for withdrawing the locking spring from the locking seat whereby the knob may be rotated to adjust the control device.

2. The invention of claim 1 wherein the release means of the said hub portion includes an inclined ramp, the said locking spring means including an inclined cam surface that is engageable by the ramp when the knob is pushed inwardly for unlocking the knob from the spring means so the knob may be turned.

3. The invention of claim 2 wherein the locking spring means is a cantilever spring that is fixed at one end adjacent the control device, the midportion of the cantilever spring includes the said inclined cam surface, and the free end of the cantilever spring includes a transverse key that is confined within the outer groove of the hub portion of the knob and is biased to engage the locking seat when they are aligned.

4. The invention of claim 3 wherein the position of the key of the locking spring within the locking seat of the outer groove constitutes the OFF position of the control device whereby the knob is incapable of being turned until the knob is first pushed in to release the locking spring.

5. The invention of claim 1 wherein the said locking spring means is fixed at one end to the control device and the outer groove substantially encircles the hub portion while the said locking seat is an elongated depression within the groove that extends in a direction parallel to the shaft of the control device so the knob may slide longitudinally of the shaft.

6. The invention of claim 1 wherein the said release means of the knob is operated by pushing in on the knob against the biasing action of the spring means.

7. The invention of claim 2 wherein the said outer groove substantially encircles the hub portion, and the inclined ramp is a tapered inner end of the hub portion and the inclined cam surface of the locking spring means substantially matches the inclined ramp.

* * * * *